US010544623B2

(12) United States Patent
Young

(10) Patent No.: US 10,544,623 B2
(45) Date of Patent: Jan. 28, 2020

(54) SECURITY SCREEN DOOR FOR SLIDING DOORS

(71) Applicant: Charles Young, San Tan, AZ (US)

(72) Inventor: Charles Young, San Tan, AZ (US)

( * ) Notice: Subject to any disclaimer, the term of this patent is extended or adjusted under 35 U.S.C. 154(b) by 0 days.

(21) Appl. No.: 16/225,149

(22) Filed: Dec. 19, 2018

(65) Prior Publication Data

US 2019/0249489 A1 Aug. 15, 2019

Related U.S. Application Data

(60) Provisional application No. 62/630,306, filed on Feb. 14, 2018.

(51) Int. Cl.
*E06B 9/52* (2006.01)
*E06B 9/04* (2006.01)

(52) U.S. Cl.
CPC . *E06B 9/52* (2013.01); *E06B 9/04* (2013.01)

(58) Field of Classification Search
CPC ..... E06B 2009/527; E06B 2009/528; E06B 9/02; E06B 9/04; E06B 9/52; E06B 9/522
See application file for complete search history.

(56) References Cited

U.S. PATENT DOCUMENTS 443,956 A * 12/1890 Crumbaugh ..... E06B 9/264 160/107
1,671,827 A * 5/1928 Kempthorne ..... E06B 3/50 160/92
3,291,192 A * 12/1966 Jones, Jr. ..... E06B 3/50 160/91
3,832,805 A * 9/1974 Stevens ..... E06B 9/02 49/503
3,879,894 A 4/1975 Anderson
4,478,267 A * 10/1984 Smiley ..... E06B 9/52 160/91
4,644,688 A * 2/1987 Benderoff ..... E05B 13/001 49/67
4,838,332 A 6/1989 Mlenek
5,105,868 A 4/1992 Riise
5,410,841 A * 5/1995 Harris ..... E05B 65/1033 49/141
5,575,321 A 11/1996 Currier
5,638,639 A * 6/1997 Goodman ..... A62C 2/24 292/21
6,009,932 A 1/2000 Smith
6,109,331 A 8/2000 Story, Jr.
6,276,091 B1 * 8/2001 Ridgway ..... E05B 65/0864 49/125
6,631,931 B2 * 10/2003 Magnusson ..... B63B 19/00 292/164

(Continued)

*Primary Examiner* — Catherine A Kelly
*Assistant Examiner* — Abe Massad
(74) *Attorney, Agent, or Firm* — Mark V. Loen

(57) ABSTRACT

The embodied invention is an outer security door design that retrofits an existing sliding door. The door design comprises an outer frame which secures into the framework of an existing sliding door. An inner rotating security screen door then fits into the outer frame. The outer frame includes important support underneath the lower frame center point, as the weight of the rotating screen door provides higher stress at that location. The outer frame allows the screen door to be latched in the open or closed position.

1 Claim, 4 Drawing Sheets

(56) References Cited

U.S. PATENT DOCUMENTS

| | | | | |
|---|---|---|---|---|
| 6,659,155 | B1 * | 12/2003 | Mlenek | E05F 1/061<br>160/117 |
| 8,661,737 | B1 * | 3/2014 | Brogan | E06B 7/28<br>49/467 |
| 8,756,883 | B2 * | 6/2014 | Glass | E06B 5/025<br>49/170 |
| 2009/0090062 | A1 * | 4/2009 | Pandorf | E06B 9/02<br>49/50 |
| 2011/0225887 | A1 * | 9/2011 | Manier | E06B 9/04<br>49/56 |

* cited by examiner

SECURITY SCREEN DOOR FOR SLIDING DOORS

CROSS REFERENCE TO RELATED APPLICATIONS

This application claims the benefit of U.S. provisional application No. 62/630,306 file on Feb. 14, 2018. The provisional application is incorporated by reference.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION

(1) Field of the Invention

This invention is directed toward outer security doors that provide additional security to a sliding door.

(2) Description of Related Art

Sliding door installations are common on many home designs. The ability to open a door that is very wide and have easy access to a backyard, porch, or deck is very common. There are, however, some disadvantages with the simplified sliding screen that is a typical feature.

A typical sliding screen that is attached to a sliding door is not designed for security. The screen door is better characterized as a bug screen, as it uses a fiber netting or a light metal screen. The frame for the screen door is not designed for security, is usually very light, and is not lockable with a key.

Screen doors are known to be used in front doors, but the installation of a common front-screen door is difficult to retrofit to a sliding door.

What is needed in the art is a screen door that provides enhanced security, a bug screen, is lockable with a key, and an easy and convenient retrofit.

BRIEF SUMMARY OF THE INVENTION

The embodied invention is an outer security door design that retrofits an existing sliding door opening. The embodied door design comprises an outer frame which is secured into the framework of an existing sliding door. An inner rotating security screen door then fits into the outer frame. The outer frame includes an adjustable center support underneath the lower frame center point, which supports the weight of the rotating screen door and lowers frame stress. The embodied design allows the screen door to be latched in the open or closed position.

BRIEF DESCRIPTION OF THE SEVERAL VIEWS OF THE DRAWING(S)

DETAILED DESCRIPTION OF THE INVENTION

Figure 1:
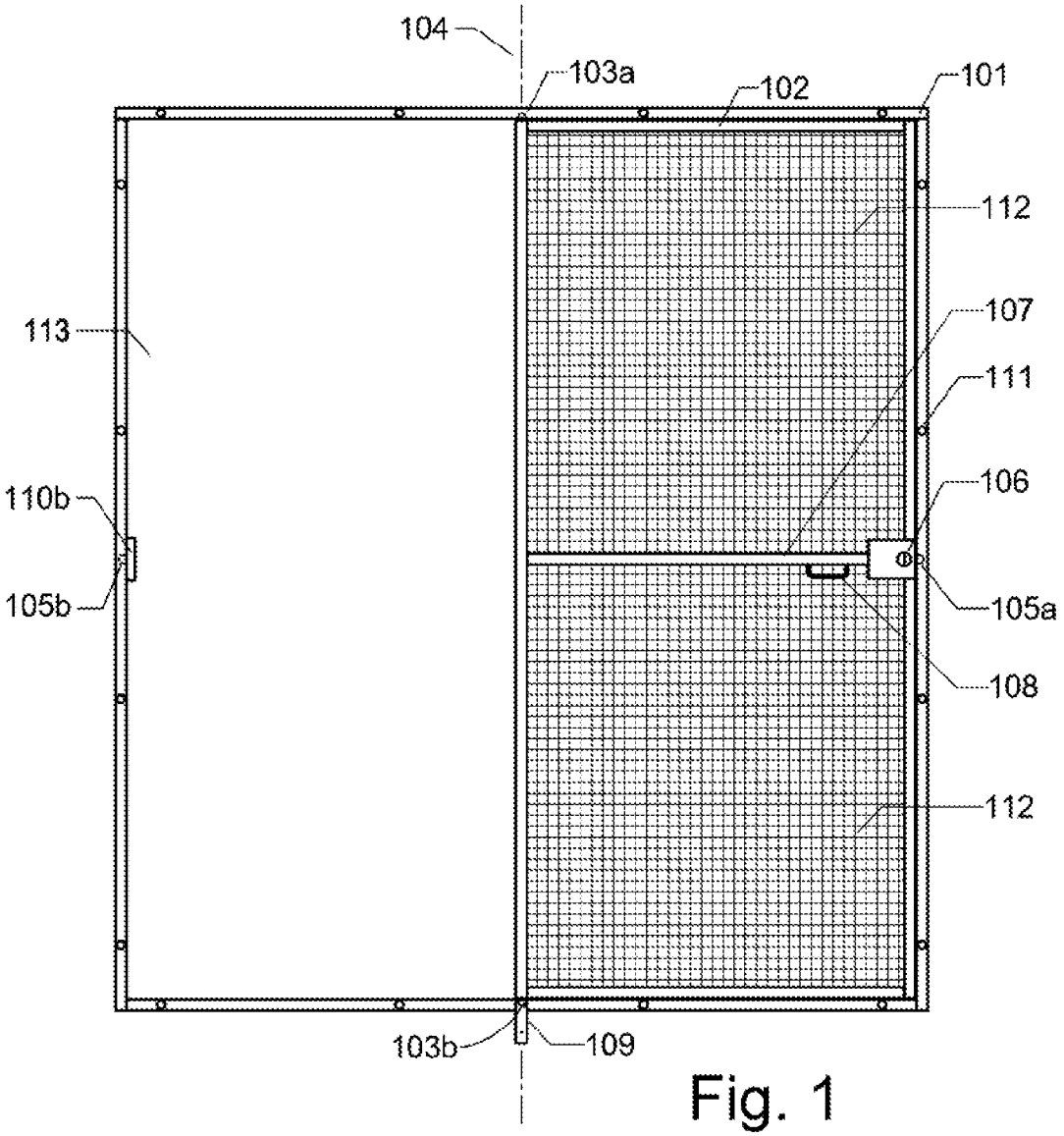
FIG. 1 shows the outer mounting frame and the rotating security door of the embodied invention.

FIG. 1 illustrates the general features of the embodied invention. An outer door frame 101 supports an inner security door frame 102, and fits into an existing sliding door window opening. The design is adaptable in width and height to fit most sliding door openings by suitable adjustments in width and height to the parts of the outer door frame. The inner and outer door frames are preferably made from a metal, such as one inch steel tubing, and are welded or fitted together. The outer frame is secured to an existing opening by use of bolts through hole openings 111 which are screwed into the existing sliding door window opening.

The inner security door rotates about a vertical axis 104 by use of an upper and lower pin 103*a,b* that fits into a hole that is drilled into the outer frame. A center support 109 provides enhanced support for the inner security screen door frame 102 by use of a metal tubing. See FIGS. 3A-3B for details of the center support 109.

FIG. 1 shows the security door in the closed position. The door is prevented from opening by a right side deadbolt-hole 105*a* and a door deadbolt. A door stop plate 110*a* (FIG. 2) is welded to the outer door frame to improve security by preventing the door from being forced inwardly. Also, when closing the door, the door stop plate 110*a* secures the door position so that the door deadbolt will correctly slide into the deadbolt-hole. A horizontal tubing 107 substantially midway between the upper and lower tubing frame adds door strength. A handle 108 provides a gripping surface for opening and closing the door. An additional handle is optionally on the other side of the door.

In the closed position, the security door deadbolt is operated by a key in the keyhole 106. In the open position, the security door deadbolt slides into a left side deadbolt-hole 105*b*. Similarly, when at the open position, the door is prevented from rotating too far by a left side door stop plate 110*b*.

The security door incorporates a metal security screen 112 made from a mesh metal, which provides enhanced strength, and resistance to forced openings. The opening 113 on the other side of the metal frame is preferably left open. In an alternate embodiment, glass is used to fill the opening 113. The glass will need to be positioned behind the door stop plate 110*b* and suitably accommodate a door handle.

Figure 2:
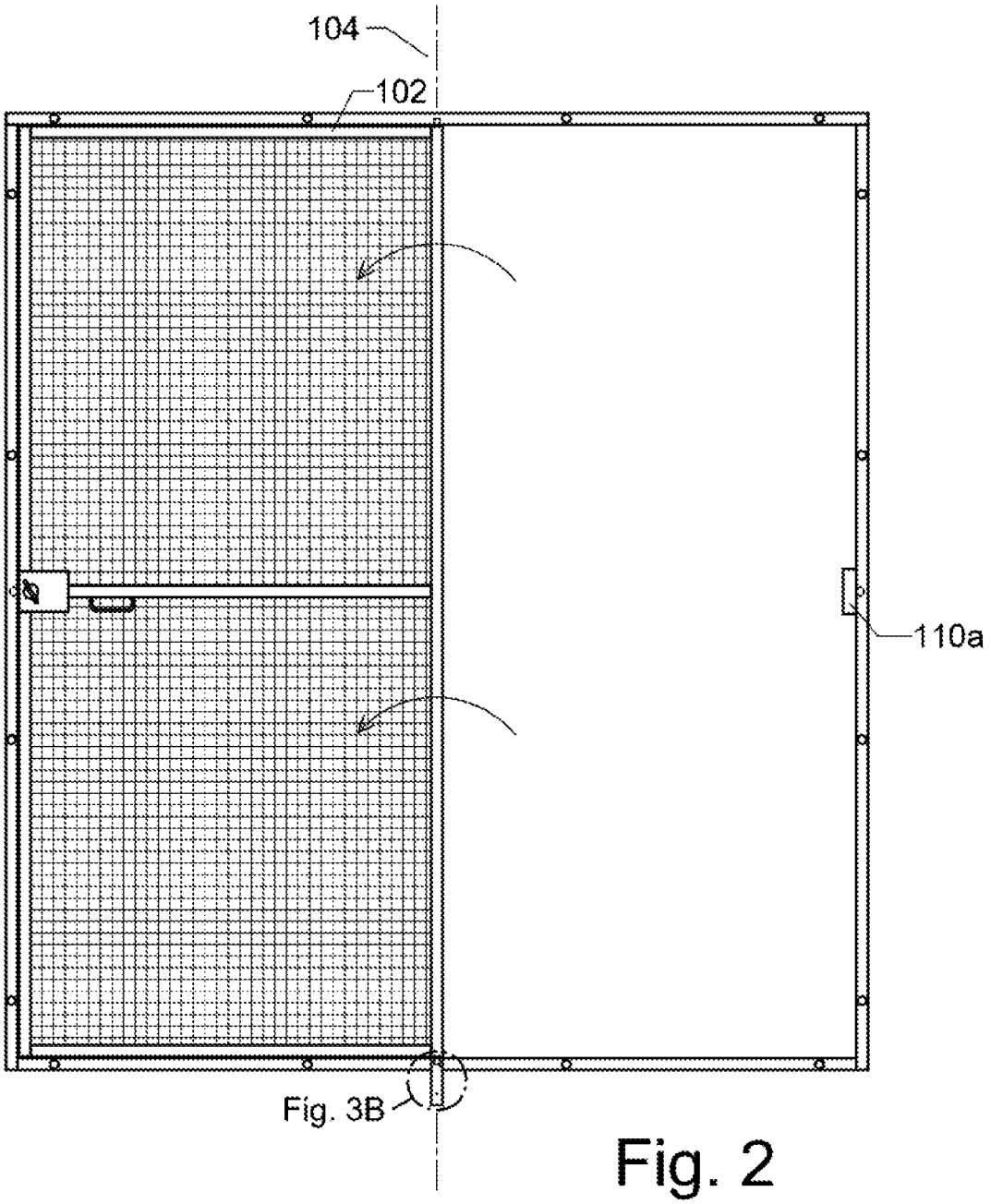
FIG. 2 shows the security door rotated to the open position.

FIG. 2 shows the security door rotated to the open position. In this view, the door stop 110*a* for the security door in the closed position is visible. Rugged door stops 110*a,b* are an important feature of the embodied invention as it provides enhanced resistance to damage if the heavier security door slams open or closed. Preferably, the door stops are made from a ½" metal bar stock and welded to the back outer door frame, so that the inner security door is flush with the outer support frame when the door is either closed or open.

For the sake of defining positions, in FIG. 1, the door is in the closed position. In FIG. 2, the door is in the open position. The viewer looks at the door when standing outside a house. However, this is not a strict requirement and is only defined for convenience and clarity of explanation. Open generally means when the door is positioned to allow someone to pass through the door opening.

It should be readily appreciated by those in the art, that the security door as seen in FIGS. 1 and 2 is designed for a right-hand orientation. The orientation of the door could equally be a left-hand orientation by relatively minor changes to the inner security door, such as flipping the door lock and relocating the door handle. The ability to easily switch the security door between left-hand and right-hand orientation is an important feature for retrofitting simplicity.

Figure 3A:
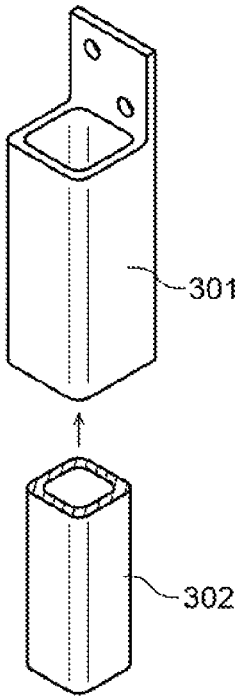
FIGS. 3A-3C show important details of the lower door support and other items.
Figure 3B:
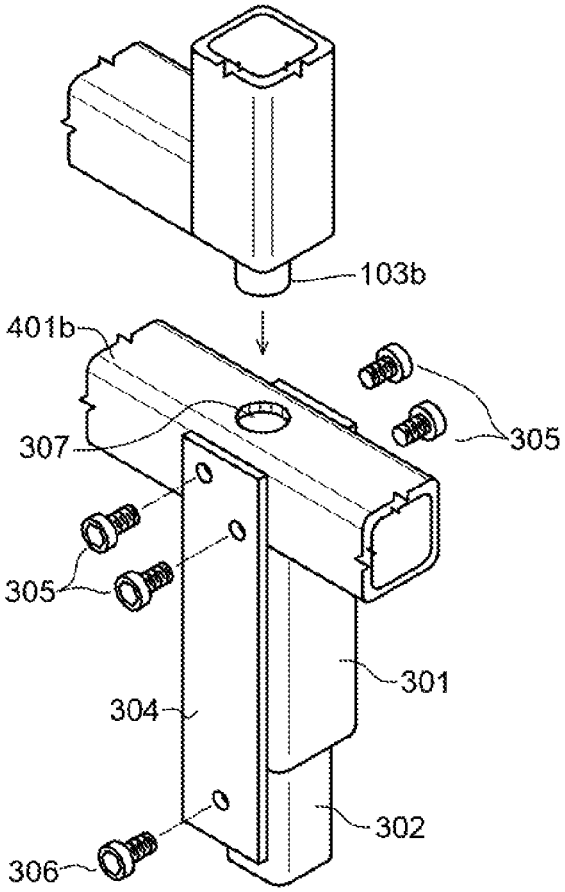

FIGS. 3A-3B shows details of the center lower support 109 as mentioned in FIG. 1. A vertical support tubing 301 is machined from 1" metal tubing stock, with attachment holes. An adjustment section 302 slides into the vertical support member as illustrated, so that the overall length of the center lower support is adjustable. FIG. 3B illustrates the assembly of the vertical support member 301, and the adjustable section 302 onto the lower outer frame tubing 401*b* using securing screws 305 through a support plate 304. The adjustment section 302 is positioned during installation and then secured in position by a position screw 306. Preferably, all screws shown in FIG. 3B are of the self taping type.

The lower pin 103*b* is inserted into the hole 307 on the lower door tubing 401*b*. An optional insert is used to lower wear between the hole and the lower door tubing. The upper pin is similarly installed on the upper outer frame tubing.

Figure 3C:
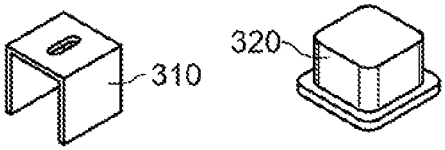
Figure 4:
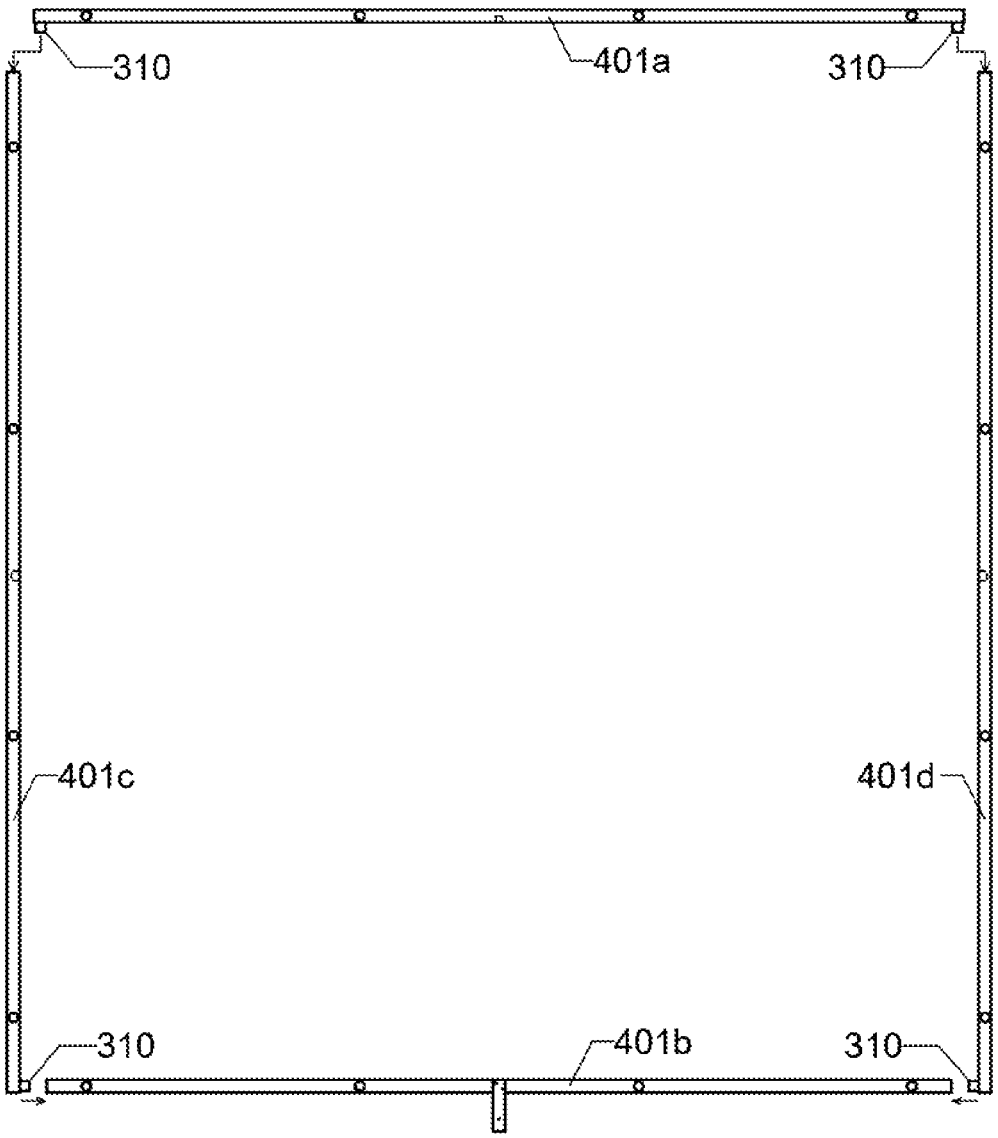
FIG. 4 illustrates the assembly of the outer door frame.

In FIG. 3C an alignment bracket 310 is used to help align the inner/outer frame and further illustrated in FIG. 4. A plastic end cap 320 is preferably used in the assembly of the inner and outer door frames to minimize sharp edges.

FIG. 4 illustrates the assembly of the outer frame. The outer frame comprises an upper horizontal support 401*a*, a lower horizontal support 401*b*, a left side vertical support 401*c* and a right side vertical support 401*d*. Preferably the four supports are made from metal tubing. An alignment bracket 310 is used to assemble the supports as illustrated. The alignment bracket fits snugly into the supports. The alignment bracket is screwed or welded onto the supports. The brackets aid in keeping the frame square and allows for some minor flexibility in length during installation.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A security door assembly for a sliding door frame comprising:

A. a rectangular shaped outer frame with attaching holes,

B. said outer frame further comprises:

i. a left vertical member and a right vertical member, and an upper member and a lower member, ii. said outer frame is made from metal tubing, iii. a lower center adjustable support, said lower center adjustable support is positioned under said lower member, iv. a first deadbolt recess located in said right vertical member and a second deadbolt recess located in said left vertical member, v. a central lower pin recess located in said upper member and a central upper pin recess located in said lower member, vi. wherein said lower pin recess and said upper pin recess are aligned vertically, and vii. a security door rotating axis that is coaxially aligned with said central lower pin recess and said central upper pin recess, C. a rectangular shaped security door, D. said rectangular shaped security door further comprises:

i. a left vertical tubing and a right vertical tubing, an upper horizontal tubing, and a lower horizontal tubing, ii. a lower pin that fits into said central lower pin recess and an upper pin that fits into said central upper pin recess, iii. said lower pin and said upper pin are coaxial with said security door rotating axis, iv. said lower pin is located on a lower end of said left vertical tubing, v. said upper pin is located on an upper end of said left vertical tubing, vi. a middle horizontal tubing centrally located between said upper horizontal tubing and said lower horizontal tubing, said middle horizontal tubing with a distal end and proximal end with respect to said rotating axis, vii. a deadbolt positioned on said distal end of said middle horizontal tubing and engages with:

a. said first deadbolt recess when said rectangular shaped security door is in a closed position, and b. said second deadbolt recess when said rectangular shaped security door is in an open position, and viii. a metal security screen positioned inside said rectangular shaped security door, E. said deadbolt is operable by a key, F. said lower center adjustable support further comprising:

i. a vertical adjustment tubing, ii. a vertical support tubing, iii. said vertical adjustment tubing slides inside said vertical support tubing, iv. a support plate, and v. screws to secure said vertical adjustment tubing and said support plate to said vertical support tubing, wherein the vertical adjustment tubing and the vertical support are substantially axially aligned with the security door rotating axis, and G. a door handle attached to said middle horizontal tubing.

* * * * *